US008243411B2

(12) United States Patent
Larson

(10) Patent No.: US 8,243,411 B2
(45) Date of Patent: Aug. 14, 2012

(54) ELECTRONIC MINIATURE CIRCUIT BREAKER WITH TRIP INDICATION USING THE BREAKER TRIPPING FUNCTION AS THE FEEDBACK MECHANISM

(75) Inventor: Brett Larson, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 416 days.

(21) Appl. No.: 12/645,172

(22) Filed: Dec. 22, 2009

(65) Prior Publication Data

US 2011/0147178 A1 Jun. 23, 2011

(51) Int. Cl.
*H01H 73/00* (2006.01)

(52) U.S. Cl. ..... 361/115

(58) Field of Classification Search ..... 361/115
See application file for complete search history.

(56) References Cited

U.S. PATENT DOCUMENTS

| | | | | |
|---|---|---|---|---|
| 4,969,063 | A | 11/1990 | Scott et al. | 361/93 |
| 5,089,796 | A | 2/1992 | Glennon et al. | 335/172 |
| 5,136,457 | A | 8/1992 | Durivage, III | 361/93 |
| 5,546,266 | A | 8/1996 | Mackenzie et al. | 361/93 |
| 6,084,756 | A | 7/2000 | Doring et al. | 361/45 |
| 2002/0158725 | A1 | 10/2002 | Nerstrom et al. | 335/17 |
| 2002/0158726 | A1 | 10/2002 | Wellner et al. | 335/18 |
| 2003/0210114 | A1 | 11/2003 | Brandon et al. | 335/21 |
| 2006/0097829 | A1 | 5/2006 | McCoy | 335/6 |
| 2008/0266732 | A1 | 10/2008 | Malingowski et al. | 361/58 |

OTHER PUBLICATIONS

PCT International Search Report for International Application No. PCT/US2010/059048 dated Feb. 25, 2010 (3 pages).

PCT International Written Opinion for International Application No. PCT/US2010/059048 dated Feb. 25, 2010 (7 pages).

*Primary Examiner* — Rexford Barnie
*Assistant Examiner* — Tien Mai
(74) *Attorney, Agent, or Firm* — Nixon Peabody LLP

(57) ABSTRACT

A method for identifying a type of fault condition in a circuit breaker includes monitoring a branch circuit for a fault condition. In response to detecting the fault condition, interrupting current flow through the branch circuit. The type of fault condition is stored in a memory device from which it is retrieved in response to receiving a control signal. The type of fault condition is indicated based on the mechanical position of a circuit breaker handle as a function of time.

19 Claims, 2 Drawing Sheets

| Cause of Trip | Push to Indicate, Trip Delay (s) | Circuit breaker Status After Indication |
|---|---|---|
| Thermal Overload | No trip | Circuit breaker "ON" |
| Instantaneous Trip | 0 | Circuit breaker "tripped" |
| Arc Fault | 2 | Circuit breaker "tripped" |
| Ground Fault | 4 | Circuit breaker "tripped" |

ELECTRONIC MINIATURE CIRCUIT BREAKER WITH TRIP INDICATION USING THE BREAKER TRIPPING FUNCTION AS THE FEEDBACK MECHANISM

FIELD OF THE INVENTION

This invention is directed generally to circuit breakers, and, more particularly, to a method for indicating a type of trip condition.

BACKGROUND OF THE INVENTION

Circuit breakers are conventionally used to protect electric power distribution circuits against arcing faults, ground faults, short circuit faults, and/or overloads. Typically, miniature circuit breakers are used particularly to protect branch circuits in homes and in commercial and light industry applications. For example, the miniature circuit breakers utilize an arc fault detector, a magnetic armature that is responsive to large magnetic forces generated by a short-circuit current, and/or a thermo-magnetic trip device that incorporates a bimetal responsive to persistent overload conditions.

When a fault or overload condition is detected on the protected circuit, the circuit breaker is tripped to open separable contacts of the circuit breaker and, thus, interrupt current flow in the protected circuit. The status of the circuit breaker is typically indicated by the position of an actuating handle, which indicates whether the circuit breaker is in an ON position, OFF position, or TRIPPED position. However, when the circuit breaker is tripped, the position of the actuating handle does not indicate the type of fault that caused the trip condition. In other words, a user cannot determine whether the circuit breaker has been tripped based on an arcing fault condition, a ground fault condition, a short circuit fault condition, or an overload condition.

To address this problem, some current circuit breaker designs include Light-Emitting Diodes (LEDs) that are multicolored or flash to indicate the reason why the circuit breaker is tripped. However, including additional components further increases the cost and complexity of the circuit breaker.

What is needed, therefore, is a trip indication for a circuit breaker that addresses the above-stated and other problems.

SUMMARY OF THE INVENTION

In an implementation of the present invention, a trip indication for a circuit breaker provides feedback to a user to indicate the cause of a fault condition that occurs on a protected branch circuit. The circuit breaker is a miniature circuit breaker that includes a handle for opening and closing a pair of separable contacts, the handle having a TRIPPED position to indicate when the circuit breaker is tripped, an ON position to indicate when current flows in the branch circuit, and an OFF position to indicate when current is interrupted from flowing through the branch circuit.

The circuit breaker further includes a push-to-test (PTT) button that signals an electronic module to perform a self test and, subsequently, to trip the circuit breaker if the electronic module passes the test (wherein, if the test is not passed the circuit breaker is not tripped). The electronic module monitors the branch circuit for a fault condition, such as an arc fault, a ground fault, a short circuit, or an overload. If the fault condition occurs, the electronic module sends a signal to a trip solenoid to open the main contacts of the circuit breaker and, thus, to interrupt the current flow in the branch circuit.

The fault condition is stored in a memory device, such as a non-volatile memory. To determine the type of fault condition, a user depresses the push-to-test (PTT) button while substantially simultaneously moving the handle to the ON position. In response, a signal is sent to the electronic module to feed back the cause of the trip. The electronic module retrieves the fault condition from the memory device and indicates the fault condition utilizing the position of the handle as a function of time.

According to an exemplary implementation, the electronic module described above is programmable to indicate (i) an overload condition by having the circuit breaker not trip (i.e., the handle remains in the ON position); (ii) an arc fault condition by having the circuit breaker trip after a certain time delay (e.g., the handle moves to the TRIPPED position after a delay of two seconds): and (iii) a ground fault condition by having the circuit breaker trip after another certain time delay (e.g., the handle moves to the TRIPPED position after a delay of four seconds).

In an alternative implementation of the present invention, a method for identifying a type of fault condition in a circuit breaker includes monitoring a branch circuit for a fault condition. In response to detecting the fault condition, current flow is interrupted through the branch circuit. The type of fault condition is stored in a memory device from which it is retrieved in response to receiving a control signal. The type of fault condition is indicated based on the mechanical position of a circuit breaker handle as a function of time.

In another alternative implementation of the present invention, a method is directed to identifying a type of fault condition in a circuit breaker for protecting a branch circuit. The circuit breaker includes a non-volatile memory device, a push-to-test (PTT) button, and a handle movable between an ON position and a TRIPPED position. The method includes monitoring the branch circuit to detect an occurrence of a fault condition, and determining the type of fault condition from a plurality of different types of fault conditions. The type of fault condition is stored in the non-volatile memory device and, in response to depressing the push-to-test (PTT) button generally simultaneously with moving the handle to the ON position, the type of fault condition is retrieved from the non-volatile memory device. In accordance with the type of fault condition, the handle is automatically positioned in one of the ON position and the TRIPPED position as a function of time.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments.

On the contrary, the invention is intended to include all alternatives, modifications and equivalent arrangements as may be included within the spirit and scope of the invention as defined by the appended claims.

Figure 1:
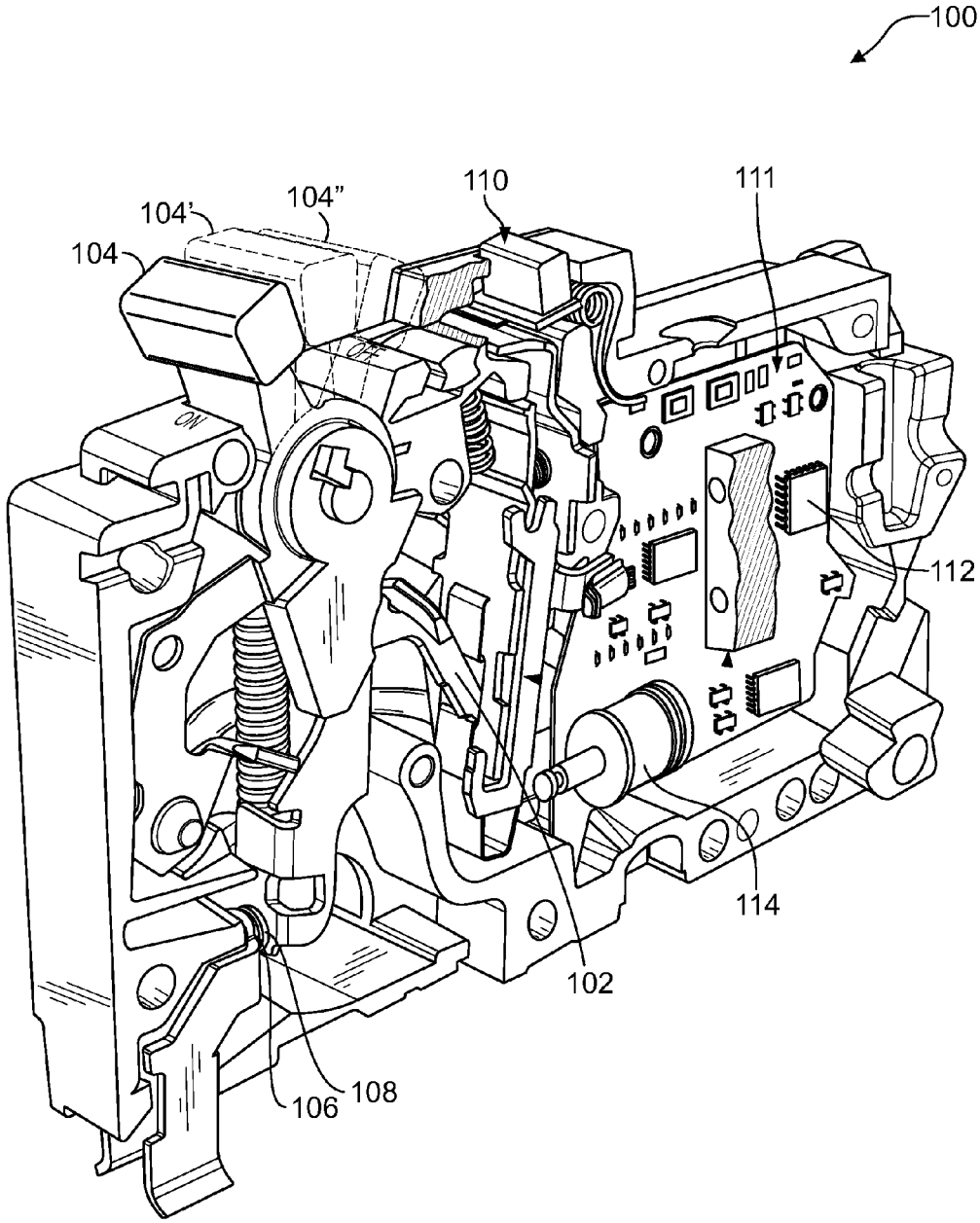
FIG. 1 is a perspective view of a circuit breaker showing internal components.

Referring to FIG. 1, a circuit breaker 100 is a miniature circuit breaker that detects occurrences of fault conditions on a protected branch circuit. The circuit breaker has a latching mechanism 102 and a handle 104. The latching mechanism 102 is used to automatically separate a pair of separable (or main) contacts 106, 108 when a certain fault condition occurs. The handle 104 is used to manually open and close the separable contacts 106, 108, and is movable between a number of circuit breaker positions, including an ON position, an OFF position, and a TRIPPED position.

In the ON position, the separable contacts 106, 108 are closed to allow current flow through the protected branch circuit. The physical position of the handle 104 in the ON position is at a leftmost counter-clockwise position (as viewed and depicted in FIG. 1).

In the OFF position, the separable contacts 106, 108 are open to prevent current flow through the protected branch circuit. Typically, the OFF position indicates a manual separation of the separable contacts 106, 108. The physical position of the handle 104 in the OFF position is at a rightmost clockwise position (shown as 104" in FIG. 1).

In the TRIPPED position, the separable contacts 106, 108 are open to prevent current flow through the protected branch circuit (similar to the OFF position). Typically, the TRIPPED position indicates an automatic separation of the separable contacts 106, 108. The physical position of the handle 104 in the TRIPPED position is between the leftmost counter-clockwise position (the ON position) and the rightmost clockwise position (the OFF position) (shown as 104' in FIG. 1).

The circuit breaker 100 further includes a push-to-test (PTT) button 110 that is utilized to signal an electronic module 111 to perform a self test. The electronic module 111 includes a microcontroller 112 with a non-volatile memory. To initiate the self test, a user depresses the push-to-test (PTT) button 110. If the electronic module 111 passes the test, the circuit breaker 100 is tripped to indicate the successful completion of the test. If the electronic module 111 fails the test, the circuit breaker 100 is not tripped, which indicates that a problem may exist.

The electronic module 111 monitors the branch circuit to determine any occurrences of fault conditions. The fault conditions can be of different types, including an arc fault condition, a ground fault condition, and an overload condition. If any fault condition occurs, the microcontroller 112 sends a signal to a trip solenoid 114 to open the separable contacts 106, 108. The opening of the separable contacts 106, 108 interrupts current flowing in the branch circuit.

When a fault condition occurs, the circuit breaker 100 is tripped and the handle 104 is automatically moved to the TRIPPED position. In the TRIPPED position, the handle 104 is automatically positioned between the ON position and the OFF position to indicate visually that a fault condition has occurred. The type of fault condition is stored in a memory device, such as the non-volatile memory of the electronic module 111.

To determine the type of fault condition that has caused the separable contacts 106, 108 to be opened, a user depresses the push-to-test (PTT) button and, then, moves the handle 104 to the ON position. In response, a control signal is sent to the electronic module 111 to indicate the cause of the trip. The electronic module 111 retrieves the type of fault condition from the memory device and, based on the position of the handle 104 as a function of time, indicates the type of fault condition to the user.

For example, in one embodiment the electronic module 111 indicates an overload condition by having the handle 104 remain in the ON position, whereupon it may trip again instantaneously if conditions warrant (as further discussed below). To indicate an arc fault condition, the electronic module 111 automatically moves the handle 104 from the ON position to the TRIPPED position after a first time delay, such as two seconds. To indicate a ground fault condition, the electronic module 111 can be programmable to automatically move the handle 104 from the ON position to the TRIPPED position after a second time delay, such as four seconds. In another example, to indicate a certain fault condition, the handle 104 is automatically moved to the TRIPPED position after no delay (i.e., substantially instantly). As such, based on (i) whether the handle 104 is moved to the ON position and (ii) whether the time elapsed between manually setting the handle 104 in the ON position and the time the handle 104 is automatically moved to the TRIPPED position, the user can determine the particular type of the fault condition that has occurred on the branch circuit.

Figure 2:
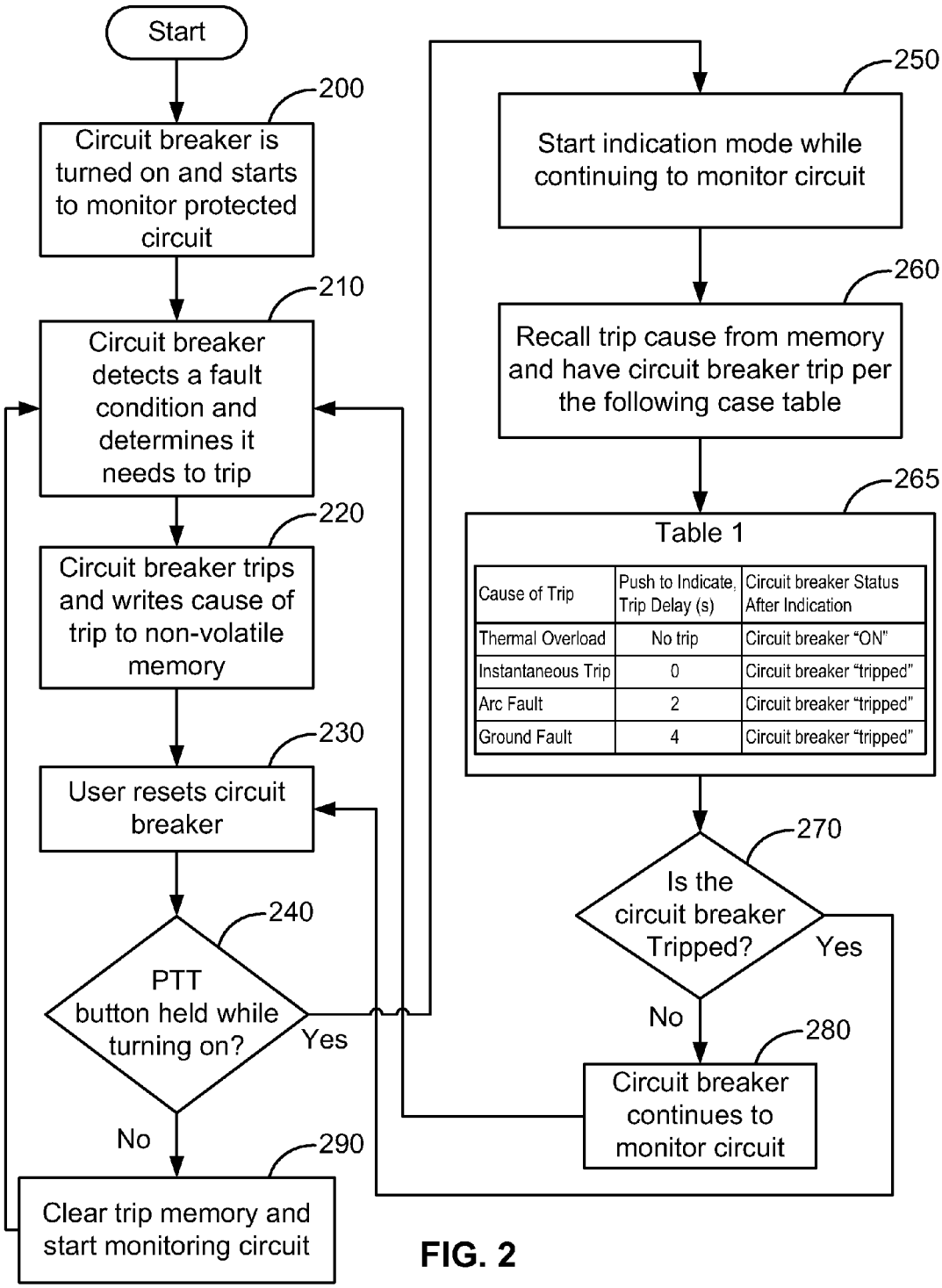
FIG. 2 is a flowchart illustrating a method for indicating a trip condition.

Referring to FIG. 2, a trip indication method includes (200) turning a circuit breaker ON to begin monitoring the protected circuit. Upon detecting a fault condition, a determination is made that the circuit breaker must be TRIPPED (210). Accordingly, the circuit breaker trips and writes the cause of the trip to non-volatile memory (220). The user resets the circuit breaker (230), for example, by manually moving the handle of the circuit breaker to the ON position.

If the push-to-test (PTT) button of the circuit breaker is held while the circuit breaker is turned ON (240), a control signal is sent to the electronic module 11 to initiate an indication mode while continuing to monitor the protected circuit (250). The cause of the trip (or type of fault condition) is retrieved from memory (260) and the circuit breaker automatically trips as a function of time in accordance with programmable parameters set in Table 1 (265). For example, if the type of fault condition was a "Thermal Overload," the circuit breaker will remain ON with no movement of the handle 104. If an "Instantaneous Trip" has occurred in response to a short circuit, the circuit breaker will automatically trip generally instantly (i.e., after zero seconds). If the type of fault condition was an "Arc Fault," the circuit breaker will automatically trip after a two-second time delay. If the type of fault condition was a "Ground Fault," the circuit breaker will automatically trip after a four-second time delay.

If the circuit breaker is tripped to indicate an "Instantaneous Trip," an "Arc Fault," or a "Ground Fault" (270), the user resets the circuit breaker (230). If the circuit breaker is not tripped, indicating a "Thermal Overload" (270), the circuit breaker continues to monitor the protected circuit (280) without any need to reset the circuit breaker.

If the push-to-test (PTT) button of the circuit breaker is not held while the circuit breaker is turned ON (240), the cause of the trip is cleared from the memory and the circuit breaker starts monitoring the circuit (290).

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A method for identifying a type of fault condition in a circuit breaker, the method comprising:

monitoring a branch circuit for a fault condition of a plurality of different types of fault conditions;

in response to detecting the fault condition, interrupting current flow through the branch circuit;

storing in a memory device the type of fault condition;

generating a control signal;

in response to the generating of the control signal, retrieving the type of fault condition from the memory device; and indicating the type of fault condition based on a mechanical position of a circuit breaker handle as a function of time.

2. The method of claim 1, wherein the different types of fault conditions include an overload condition, a ground fault condition, and an arc fault condition.

3. The method of claim 1, wherein the mechanical position of the circuit breaker handle automatically changes between an ON position and a TRIPPED position.

4. The method of claim 1, wherein (i) a first type of fault condition is indicated by having the circuit breaker handle remain in a first mechanical position, and (ii) a second type of fault condition is indicated by having the circuit breaker handle automatically move to a second mechanical position within a preselected time period after receiving the control signal.

5. The method of claim 1, wherein (i) a first type of fault condition is indicated by having the circuit breaker handle automatically move from a first mechanical position to a second mechanical position after a first time delay, and (ii) a second type of fault condition is indicated by having the circuit breaker handle automatically move from the first mechanical position to the second mechanical position after a second time delay, each of the first time delay and the second time delay being measured from the time the control signal is generated.

6. The method of claim 1, wherein (i) a first type of fault condition is indicated by having the circuit breaker handle remain in a first mechanical position after the control signal is generated, (ii) a second type of fault condition is indicated by having the circuit breaker handle automatically move to a second mechanical position after a first time delay, and (iii) a third type of fault condition is indicated by having the circuit breaker handle automatically move to the second mechanical position after a second time delay, each of the first time delay and the second time delay being measured from the time the control signal is generated.

7. The method of claim 1, wherein the control signal is generated in response to a push-to-test (PTT) button being depressed the circuit breaker handle being moved to an ON position, and wherein (i) a first type of fault condition is indicated by having the circuit breaker handle remain in the ON position after receiving the control signal, (ii) a second type of fault condition is indicated by having the circuit breaker handle automatically move to a TRIPPED position after a first time delay, and (iii) a third type of fault condition is indicated by having the circuit breaker handle automatically move to the TRIPPED position after a second time delay, the second time delay being greater than the first time delay, each of the first time delay and the second time delay being measured from the time the control signal is generated.

8. The method of claim 1, further comprising depressing a push-to-test (PTT) button while substantially simultaneously moving the circuit breaker handle to a specific mechanical position to generate the control signal.

9. The method of claim 8, wherein the circuit breaker handle is moved to an ON position.

10. The method of claim 1, wherein the memory device is non-volatile memory.

11. The method of claim 1, wherein the interrupting of the current flow is achieved by separating a pair of separable contacts of the circuit breaker.

12. The method of claim 1, further comprising clearing the type of fault condition from the memory device if the control signal is not generated.

13. The method of claim 1, further comprising continuing monitoring the branch circuit while indicating the type of fault condition.

14. The method of claim 1, further comprising activating a solenoid to interrupt current flow in response to detecting the fault condition, the activating of the solenoid causing the opening of a pair of separable contacts.

15. A method for identifying a type of fault condition in a circuit breaker for protecting a branch circuit, the circuit breaker including a non-volatile memory device, a push-to-test (PTT) button, and a handle movable between an ON position and a TRIPPED position, the method comprising:

monitoring the branch circuit to detect an occurrence of a fault condition;

determining the type of fault condition from a plurality of different types of fault conditions;

storing in the non-volatile memory device the type of fault condition;

in response to depressing the push-to-test (PTT) button and moving the handle to the ON position, retrieving the type of fault condition from the non-volatile memory device; and in accordance with the type of fault condition, automatically positioning the handle in one of the ON position and the TRIPPED position as a function of time.

16. The method of claim 15, further comprising providing an electronic module for associating each of the different types of fault conditions with a (i) specific position of the handle and (ii) a specific time delay from the time the push-to-test (PTT) button is depressed, the different types of fault conditions including at least an overload condition, an arc fault condition, and a ground fault condition.

17. The method of claim 16, wherein the overload condition is indicated by positioning the handle in the ON position, the handle remaining in the ON position to indicate the type of fault condition.

18. The method of claim 16, wherein the arc fault condition is indicated by automatically moving the handle from the ON position to the TRIPPED position after a time delay of at least two seconds.

19. The method of claim 16, wherein the ground fault condition is indicated by automatically moving the handle from the ON position to the TRIPPED position after a time delay of at least four seconds.

* * * * *